US005653360A

United States Patent [19]

Brandhorst et al.

[11] Patent Number: 5,653,360

[45] **Date of Patent: *Aug. 5, 1997**

[54] DEVICE FOR EMPTYING A FILM TUBE

[75] Inventors: Gerd Brandhorst, Landsberg; Wolf-Dietrich Herold, Seefeld; Ralf Heiduczek, Gröbenzell, all of Germany

[73] Assignee: Thera Patent GmbH & Co. KG Gesellschaft fur Industrielle Schutzrechte, Seefeld, Germany

[ * ] Notice: The term of this patent shall not extend beyond the expiration date of Pat. No. 5,501,368.

[21] Appl. No.: 574,697

[22] Filed: Dec. 19, 1995

Related U.S. Application Data

[63] Continuation of Ser. No. 371,219, Jan. 11, 1995, Pat. No. 5,501,368.

[30] Foreign Application Priority Data

Jan. 13, 1994 [DE] Germany ..... 9400524 U

[51] Int. Cl.[6] ..... B65D 35/28

[52] U.S. Cl. ..... 222/95; 222/326

[58] Field of Search ..... 222/95, 105, 326, 222/327, 386, 386.5

[56] References Cited

U.S. PATENT DOCUMENTS

| | | | |
|---|---|---|---|
| 2,477,875 | 8/1949 | Hutchason | 222/95 |
| 3,815,787 | 6/1974 | Spies | 222/95 |
| 5,069,364 | 12/1991 | McGill | 222/326 |
| 5,150,820 | 9/1992 | McGill | 222/326 |
| 5,286,105 | 2/1994 | Herold et al. | 366/177 |
| 5,322,122 | 6/1994 | Jennings, Jr. | 166/307 |
| 5,501,368 | 3/1996 | Brandhorst et al. | 222/95 |

FOREIGN PATENT DOCUMENTS

| | | | |
|---|---|---|---|
| 2186544 | 8/1987 | United Kingdom | 222/95 |

*Primary Examiner*—Philippe Derakshani
*Attorney, Agent, or Firm*—Foley & Lardner

[57] ABSTRACT

For emptying a film tube 15 containing a flowable substance, the front end of the tube is provided with a ring 17 the peripheral portion 19 of which exceeds the inner diameter of a cartridge 1 which receives the tube 15. The ring 17 has a conical sealing surface 20 which cooperates with a sealing edge 12 formed inside the cap 2. In operation, the cylindrical rear portion 7 of the cap 2 is slid onto a front portion 4 of the cartridge 1, whereby the ring 17 provided on the tube 15 has its sealing surface 20 centered and aligned in the radial and axial directions to ensure proper engagement between the sealing edge 12 and the sealing surface 20.

5 Claims, 1 Drawing Sheet

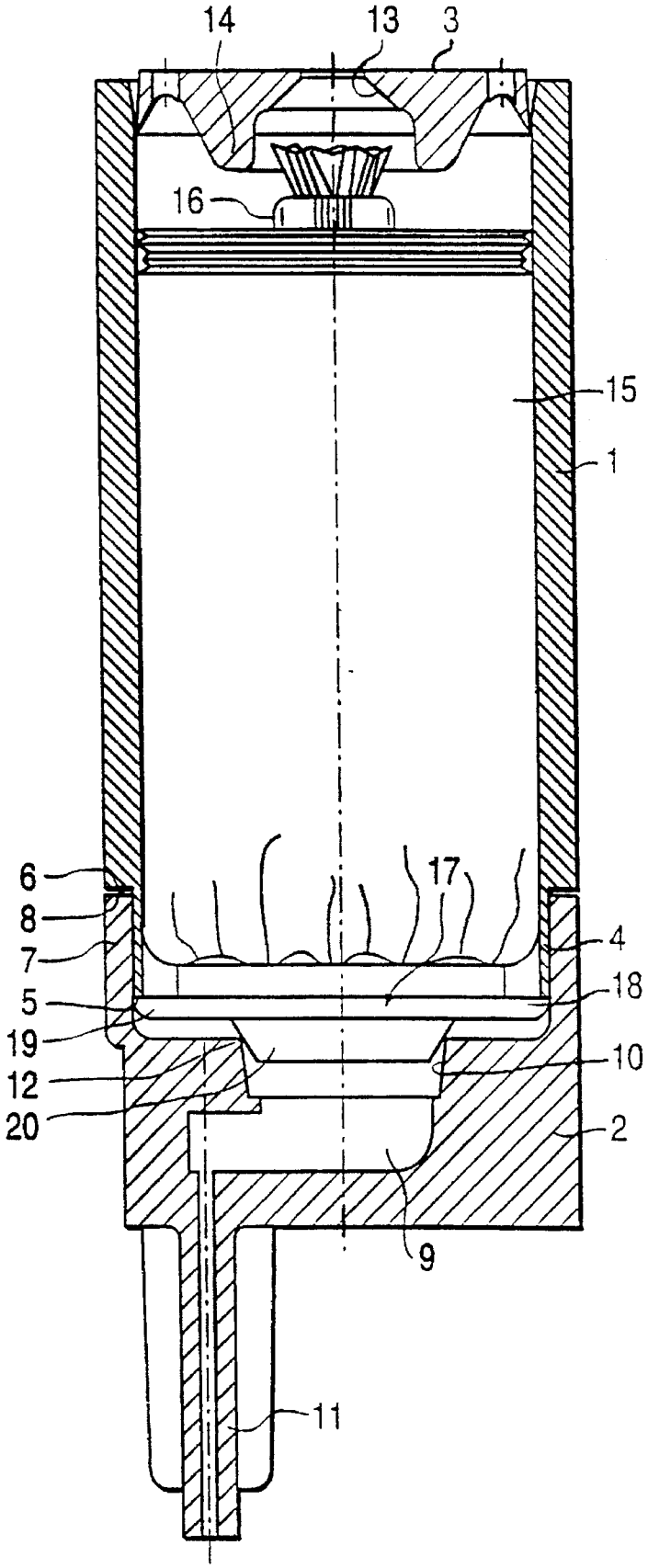
14
13
3
16
15
1
6
8
7
5
19
12
20
17
4
18
10
2
9
11

DEVICE FOR EMPTYING A FILM TUBE

This is a continuation of Ser. No. 371,219, filed Jan. 11, 1995, now U.S. Pat. No. 5,501,368.

BACKGROUND OF THE INVENTION

A device for emptying a film tube containing a flowable substance is known from U.S. Pat. No. 5,332,122, wherein the dispensing end of the tube carries a ring having a conical sealing surface, the device including a cylindrical housing for receiving the film tube between a displaceable piston and a cap. A dispensing opening is provided in the cap which has an annular surface for engaging the conical sealing surface of the ring mounted on the tube.

For operating the known device, the film tube is inserted into the cylindrical housing from the front or rear end thereof, whereupon the cap is connected to the front end of the housing and the piston is inserted into the rear end. At this time, the conical sealing surface of the ring comes into contact with an engaging portion provided in the cap, which is intended to make sure that the tube, which has been cut open at a position beyond the ring, can be emptied only through the dispensing opening of the cap while preventing any material from reaching the space between the cap, the tube and the container. Since the sealing force is derived from the dispensing pressure produced by advancement of the piston, it is automatically increased whenever dispensing pressure is applied.

Proper operation of the known device requires the ring to be correctly mounted on the film tube in the radial and angular directions. Since the tube is manufactured from a length of tubular sheet material and has its ends simply squeezed and sealed by clips, inaccuracies in mounting the ring on the crimped tube end by means of adhesive cannot be avoided. In practice there will be cases where the ring and thus its conical sealing surface are disposed obliquely or eccentrically with respect to the axis of the sealing counter surface provided in the cap. This may result in incomplete sealing.

If the tube contains a substance of relatively low viscosity, such as a fresh catalyst, there is a chance for the substance to start flowing out even at low pressure exerted on the piston and before a sufficient pressure has been established between the sealing surfaces of the ring and the cap. In this situation, the escaping substance may reach the area of the sealing surfaces and eventually prevent a sufficient seal.

It may further happen in practice that the outer diameter of the film tube is at its upper tolerance limit, or that the outer surface of the tube or the inner surface of the cylindrical housing is polluted. In this case, if the tube is inserted into the housing from the rear, it may become jammed and may not reach its foremost position, so that the sealing surface of the ring does not reach the counter surface of the cap. The same may happen when the tube is inserted from the front and is moved too far into the housing. No proper sealing is ensured in these cases.

The described seal at the front end of the film tube is of particular significance when the tube contains one of two or more components which are simultaneously dispensed to prepare a mixture of substances. In such a case, an exact mixing ratio is essential to achieve a finished material of desired properties; this requires a predetermined quantity of each component to be dispensed completely.

A further reason why the seal is important is the fact that in dispensing devices of the type under consideration, only the tube is designed as a disposable item whereas the housing and the cap should be parts of a re-usable device. Pollution of the interior of the housing and of the rear area of the cap may render these parts of the device useless.

SUMMARY OF THE INVENTION

It is an object of the invention to provide a device for emptying a film tube in which the seal between the front end of the tube and the cap is ensured to an even greater extent than heretofore.

This object is met by a device for emptying a film tube which contains a flowable substance and has a dispensing end provided with a ring, the device comprising a cylindrical housing with a displaceable piston and a cap and being adapted to receive the tube between the piston and the cap, the cap having a dispensing opening and an annular engaging portion surrounding the opening and cooperating with the ring for sealing the dispensing end of the tube, wherein the housing has a supporting surface which faces the cap and the ring has a peripheral portion which exceeds the inner diameter of the housing for engaging the supporting surface.

As a result of the ring being made larger than the inner diameter of the housing, the film tube may be inserted into the housing only from the dispensing end thereof. When the housing and the cap are subsequently locked together, engagement between the sealing surfaces provided on the ring and the cap is automatically ensured. If the tube is jammed within the housing and therefore cannot be completely inserted, all that may happen is that the housing and the cap cannot be interlocked which will be readily discovered.

Further, the ring is automatically aligned by virtue of its peripheral zone engaging a supporting surface of the housing which faces the cap, even in case the ring should have been adhered to the tube in a slanting way. When the container and cap are interlocked, the ring is forced into position by the sealing surface bearing against the annular abutment provided in the cap, on the one hand, and the peripheral zone of the ring bearing against the supporting surface of the housing, on the other hand.

In a preferred embodiment, an end portion of the housing and a cylindrical end portion of the cap are adapted to engage each other, the peripheral portion of the ring being centred by the inner wall of the outer one of the two end portions. This results in the advantage that the ring is automatically centred when the housing and the cap are fitted together, whereby the conical sealing surface of the ring is precisely aligned with the counter surface of the cap.

In another embodiment, the end portions of the housing and the cap have such axial dimensions that a play is retained between their mutually facing surfaces when the ring abuts the engaging portion of the cap and the peripheral portion of the ring abuts the supporting surface of the housing. This ensures that the pressure which is exerted on the rear end of the tube when the piston is advanced, is utilised to produce a sealing force between the ring and the cap even when the film tube becomes jammed in the interior of the housing. In such a case, the play existing between the housing and the cap permits the tube exposed to the pressure to entrain the housing to such an extent that the sealing force is safely produced.

Preferably, the ring has a conical sealing surface and the engaging portion is formed by an annular edge of the cap. A high sealing pressure is achieved due to the small area of contact between the ring and the cap.

BRIEF DESCRIPTION OF THE DRAWING

A preferred embodiment of the invention will now be explained in detail by reference to the drawing which shows a longitudinal section through an emptying device with a film tube inserted.

DETAILED DESCRIPTION OF PREFERRED EMBODIMENT

According to the drawing, the device consists of a cylindrical cartridge 1 which constitutes the housing referred to above and in the claims, a substantially rigid cap which placed on the front end (the lower end in the drawing) of the cartridge 1, and a piston 3 inserted in the cartridge from the rear end thereof for movement therein. The cartridge 1 is manufactured from a length of stiff cylindrical tube of uniform inner diameter and made of synthetic material, and has a front end portion 4 of reduced outer diameter which forms a front edge 5 of the cartridge 1 and an outer annular shoulder 6.

The cap 2 has a hollow cylindrical end portion 7 which forms a rear edge 8 and in the assembled condition surrounds the end portion 4 of the cartridge 1. The cap 2 is perforated to form a dispensing opening 9 which at its rear end begins with a conical inlet 10 and at its front end terminates in a nozzle 11. The rear end of the inlet 10 forms an annular sealing edge 12 (which in practice is a small sealing surface) coaxial with the axis of the cartridge 1.

The drawing shows a soft-flexible film tube 15 inserted in the cartridge 1, the rear end of which is shown as closed by a clip 16. The tube 15 contains a more or less viscous substance which, in a typical application, may be a dental impression mass. The piston 3 has an axial recess 13 to receive the crimped portion of the tube 15 extending beyond the clip 16. The piston 3 thus has a forward directed annular portion 14 that bears against the rear end of the tube 15.

In the drawing, the rear end of the film tube 15 is shown as already somewhat compressed, although the piston 3 is shown in a retracted position. This representation, while not showing an actual operating condition, has been chosen for clarity.

The front end of the film tube 15 carries a ring 17 which has its rearward facing edge glued to the tube 15. The ring 17 has an outward flange 18 the peripheral portion 19 of which has an outer diameter that exceeds the inner diameter of the cartridge 1. The front end of the ring 17 constitutes a forward tapering conical sealing surface 20.

In operation of the device, a film tube 15, which is filled with a substance to be dispensed, is inserted into the cartridge 1 from the front end thereof until the peripheral portion 19 of the ring flange 18 abuts the front edge 5 of the cartridge 1. The end of the tube 15, which extends forward through the ring 17 and is shaped similar to its rear end is cut off together with a clip provided on the front end.

The cap 2 is then placed on the cartridge 1 with its end portion 7 surrounding the end portion 4 of the cartridge 1 so that the sealing edge 12 formed by the inlet 10 engages the sealing surface 20 of the ring 17.

The end portions 4 and 7 of the cartridge 1 and the cap 2 are dimensioned so that in the assembled condition a gap remains between the shoulder 6 and the rear edge 8. Similarly, the front of the ring 17 and the rear side of the cap 2 are so shaped and dimensioned that an air space remains in front of the ring 17 outside the conical sealing surface. This ensures the cartridge 1, the cap 2 and the ring 17 to engage each other in the described way when the cap 2 is locked to the cartridge 1. While no locking means have been shown in the drawing they may be constituted, for instance, by placing the cartridge 1 with the cap 2 and the tube 15 in a correspondingly designed apparatus which includes a drive for the piston 3. An apparatus of this type is described in U.S. Pat. No. 5,286,105.

Should the ring 17 be glued to the film tube 15 in a slanting way, it will be automatically aligned by the peripheral portion 19 engaging the front edge 5 of the cartridge 1. Further, any radial displacement of the ring 17 will be compensated by the inner surface of the end portion 7 of the cap 2. To achieve this compensation, the outer diameter of the ring flange 18 is only slightly smaller than the inner diameter of the end portion 2 thereby providing a guiding effect. When the cap 2 is placed on the cartridge 1 and locked thereto, the conical sealing surface provided on the ring 17 is automatically aligned with the sealing edge 12 provided in the cap 2.

When pressure is subsequently exerted on the rear end of the tube 15 by the advancing piston 3, this pressure is transmitted forward through the tube 15 and is available there as sealing pressure. Should the tube 15 become jammed inside the cartridge 1 it will tend to move the cartridge 1 when the piston 3 is advanced. At this time, the gap provided between the end edge 8 and the shoulder 6 permits such a (small) movement that the described sealing pressure is attained.

In case the tube 15 cannot be fully inserted into the cartridge 1 due to excess manufacturing tolerance or due to pollution or in case foreign matter should have become included in the sealing area, locking between the cartridge 1 and the cap 2 will be impossible and this will be recognized before the device is actuated.

Only a single cartridge has been shown in the drawing. This cartridge may be part of a paired arrangements as provided in the device disclosed in U.S. Pat. No. 5,286,105. For the same reason, the dispensing nozzle 11 is offset laterally from the axis. As initially stated, exact and complete dispensing of material in accordance with the advancement of the piston is essential particularly in such double or multiple arrangements for producing mixtures of components.

We claim:

1. A device for emptying a film tube which contains a flowable substance and has a dispensing end provided with a ring, the device comprising a cylindrical housing with a displaceable piston and a cap and being adapted to receive the tube between said piston and said cap, said housing having an inner diameter and including an end portion having a ring support surface, the cap having a dispensing opening, an annular engaging portion surrounding the dispensing opening and cooperating with said ring for sealing the dispensing end of the tube, and a cylindrical end portion adapted to engage the end portion of the housing, said ring having a peripheral portion which exceeds the inner diameter of the housing for engaging said ring supporting surface, and wherein a gap remains between mutually facing surfaces of said end portions of the housing and the cap when said housing, cap and tube are assembled with said ring abutting said engaging portion of the cap and the peripheral portion of said ring abutting said supporting surface of said housing.

2. The device of claim 1, wherein the end portion of the cap surrounds the end portion of the housing, said ring supporting surface being formed by an end edge of the housing.

3. The device of claim 1, wherein said ring has a conical sealing surface and said engaging portion or said cap is formed by an annular edge of said cap.

4. A device for emptying a film tube which contains a flowable substance and has a dispensing end provided with a ring, the device comprising a cylindrical housing having an end portion, a displaceable piston and a cap and being adapted to receive the tube between said piston and said cap, the cap having a dispensing opening and an annular engaging portion surrounding the dispensing opening and cooperating with said ring for sealing the dispensing end of the tube, the housing having a ring supporting surface which faces the cap, and the ring having a peripheral portion which exceeds the inner diameter of the housing for engaging said ring supporting surface, the end portion of the housing being further formed with an annular shoulder, said cap having an edge portion facing said annular shoulder, the housing and the cap being so dimensioned in the moving direction of said piston that a play is retained between said annular shoulder and said edge portion when said ring abuts said annular engaging portion of the cap and the peripheral portion of said ring abuts said ring supporting surface.

5. The device of claim 4, wherein the end portion of the housing has an inner wall and the end portion of the cap has an inner wall, the peripheral portion of the ring being centered by the inner wall of the outer one of said two end portions.

* * * * *